US006273584B1

(12) United States Patent
Wang et al.

(10) Patent No.: US 6,273,584 B1
(45) Date of Patent: Aug. 14, 2001

(54) CHRISTMAS LIGHT TREE

(76) Inventors: Jessica Wang; Dennis Wang, both of 4F-3, No. 77, Sec. 2, TUN HWA South Road, Taipei (TW)

( * ) Notice: Subject to any disclaimer, the term of this patent is extended or adjusted under 35 U.S.C. 154(b) by 0 days.

(21) Appl. No.: 09/471,166

(22) Filed: Dec. 23, 1999

(51) Int. Cl.[7] ..... F21S 6/00

(52) U.S. Cl. ..... 362/123; 362/431; 362/806; 362/807

(58) Field of Search ..... 362/123, 431, 362/806, 807

(56) References Cited

U.S. PATENT DOCUMENTS 3,674,612 * 7/1972 Gehl ..... 362/123
3,970,834 * 7/1976 Smith ..... 362/123
4,620,270 * 10/1986 Laakso ..... 362/123
5,934,793 * 8/1999 Rahman ..... 362/249

* cited by examiner

*Primary Examiner*—Sandra O'Shea
*Assistant Examiner*—Ali Alavi
(74) *Attorney, Agent, or Firm*—Dougherty & Troxell

(57) ABSTRACT

A Christmas light tree composed of a central post and a plurality of supporting rings surrounding the central post is disclosed. The Christmas light tree includes a central post that has a plurality of sections detachably connected to each other. The central post has top and bottom ends, which the top end is attached with a top supporting ring and the bottom end is attached with a stand. A star-shape member containing bulbs therein is attached to the top supporting ring. A number of supporting rings arranged separately in the same axis with the top supporting ring. Each supporting ring has a different diameter and the diameter of the supporting rings increases from the top supporting ring to the bottommost supporting ring. A wire net attached with numerous bulbs is attached and fixed on the supporting rings making the decorative light net looks like a Christmas tree.

6 Claims, 3 Drawing Sheets

CHRISTMAS LIGHT TREE

BACKGROUND OF THE INVENTION

1. Field of the Invention

The present invention generally relates to a decorative light set, and in particular to a decorative light tree set for supporting a decorative light net thereon. The decorative light tree set mainly comprises a central post, and a plurality of supporting rings with different diameter surrounding the central post, incorporating with a light net attached on the supporting rings, to form an easily assembling decorative light tree.

2. Description of the Prior Art

Decorative light strings are widely used in holidays and festivals, especially Christmas. A light string usually is composed of a plurality of bulb sockets and an electrical wire for connecting the bulb sockets. Each of the bulb sockets may receive and hold a light bulb thereon. Typically, the light bulbs arranged on the light string are electrically connected in series to form a series circuit loop. An electric plug may be provided at one end of the light string for connection with an external power source. Further, an electric socket may be connected at the other end of the light string to provide an electrical connection to another light string to form an extendible long light string.

Since the electrical wires are usually not rigid enough to support themselves in the space, usually the light strings are just simply wound around a conifer or a plastic tree. Therefore, a conventional supporting frame is commonly adapted to support and arrange the light strings into desired shapes.

The conventional supporting frame is made of rigid materials, such as metal or plastic members, forming a rigid frame. Some of the light strings supporting frames have a knockdown structure allowing a user to detach/disassemble parts thereof thereby reducing the amount of space required for storage. However, the user still needs to spend some more time to arrange the decorative light string on the supporting frame on his own.

It is thus desirable to have a light tree set having a simple structure and can be easily and conveniently assembled for overcoming the problem discussed above.

SUMMARY OF THE INVENTION

Accordingly, a primary object of the present invention is to provide a Christmas light tree having a simple structure.

The second object of the present invention is to provide a decorative light net having a tree-like configuration.

One more object of the present invention is to provide a decorative light tree set that is easily to assemble. Furthermore, the decorative light tree set is preferably composed of flexible members thereby facilitating storage thereof.

To achieve the above objects, in accordance with the present invention, there is provided a Christmas light tree comprising a central post that has a plurality of sections detachably connected to each other. The central post has top and bottom ends, which the top end is attached with a top supporting ring and the bottom end is attached with a stand. A star-shape member containing bulbs therein is attached to the top supporting ring. A number of supporting rings arranged separately in the same axis with the top supporting ring. Each supporting ring has a different diameter and preferably the diameter of the supporting rings increases from the top supporting ring to the bottommost supporting ring. A wire net attached with numerous bulbs is attached and fixed on the supporting rings making the decorative light net looks like a Christmas tree.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENT

Figure 1:
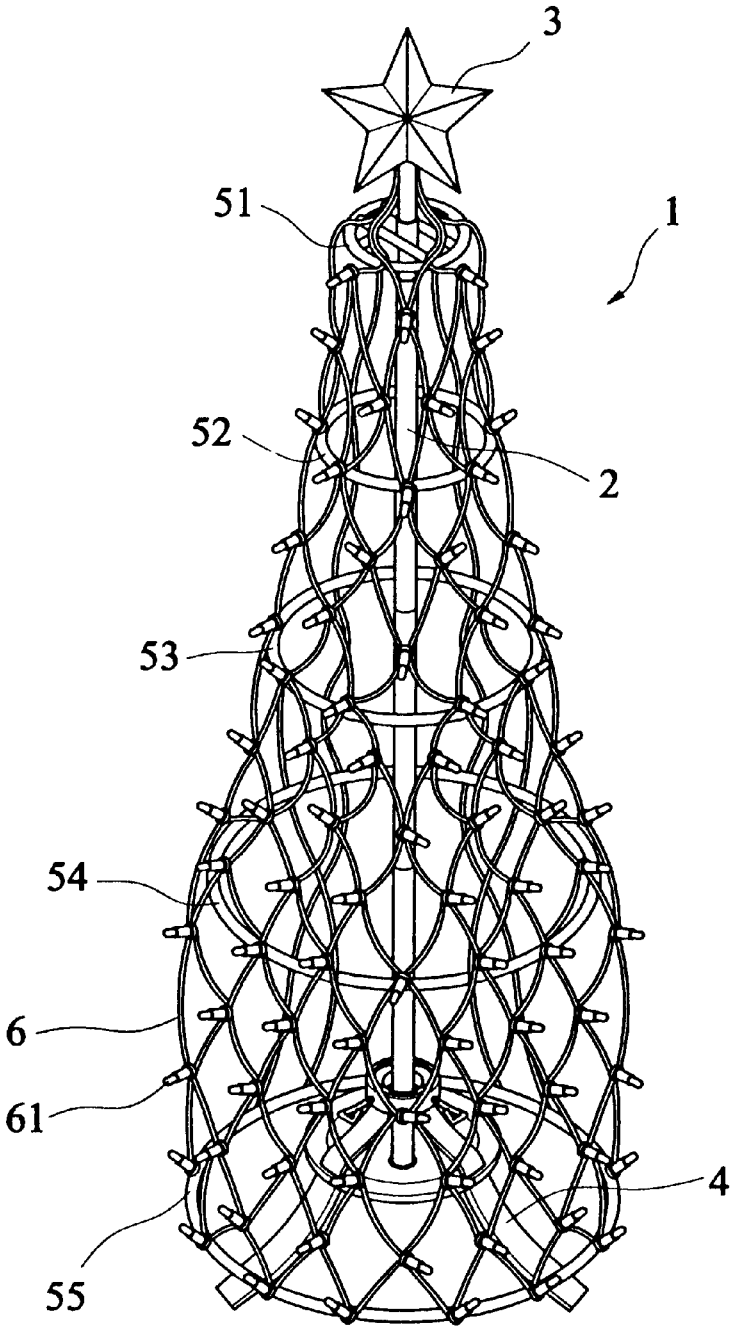
FIG. 1 is a perspective view of a Christmas Light tree in accordance with the present invention.

With reference to the drawings and in particularly to FIG. 1, a Christmas light tree constructed in accordance with the present invention, generally designated with reference numeral 1, is shown. The Christmas light tree 1 comprises an upright central post 2 having top and bottom ends. A stand 4 is attached to the bottom end and a star-shape member 3 is attached to the top end of the central post 2.

A number of supporting rings 51, 52, 53, 54, and 55 with different diameters are arranged separately from the top to the bottom surrounding the central post 2. Preferably, the diameter of each supporting ring increases sequentially from supporting rings 51 to 55 thereby forming a shape of a Christmas tree. A wire net 6 attached with numerous bulbs 61 is attached on the supporting rings 51–55.

The wire net 6 comprises a number of wires to form a rhombus-shape mesh. There are bulbs 61 attached on each node of the mesh where the wires crossed. The wire net 6 may be fixed on the intersection of the wires and the supporting rings 51, 52, 53, 54, and 55 by clips (not shown) to form a Christmas-tree-shape light net. An extending wire attached with an electric plug (not shown) connected to the wire net 6 for supplying power thereto.

Figure 2:
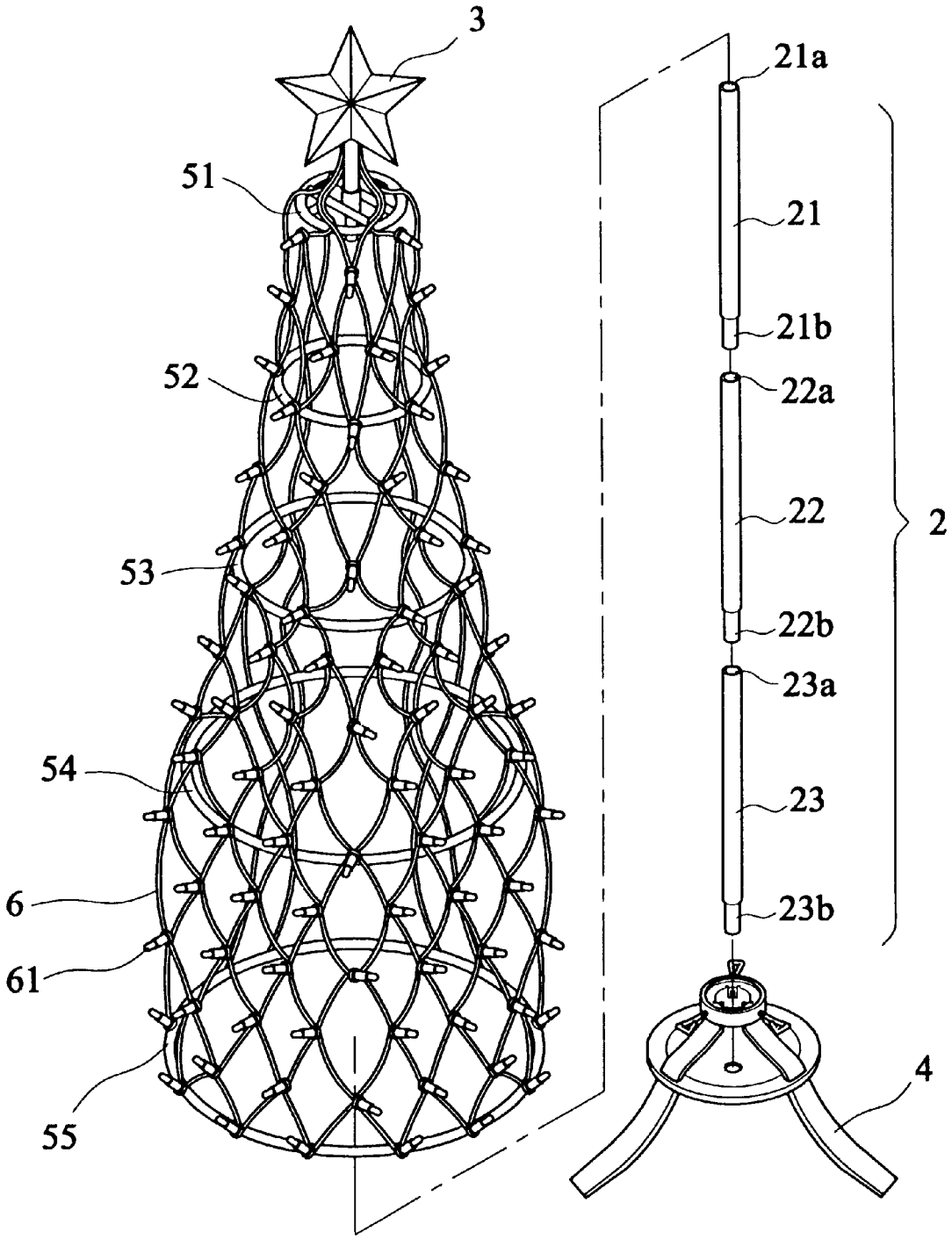
FIG. 2 is an exploded view of the Christmas Light tree in accordance with the present invention.

In a preferred embodiment as illustrated in FIG. 2, the central post 2 comprises a plurality of sections 21, 22, and 23 detachably connected to each other. The topmost section 21 has an open end 21*a* for being attached to the star-shape member 3 and a reduced end 21*b* for being received in an open end 22*a* of the next section 22. Section 22 also has a reduced end 22*b* for being received in an open end 23*a* of the bottommost section 23. Section 23 has a reduced end 23*b* for inserting into and being locked with the stand 4. The stand 4 has three feet to support the Christmas light tree standing balancedly and steadily.

Figure 3:
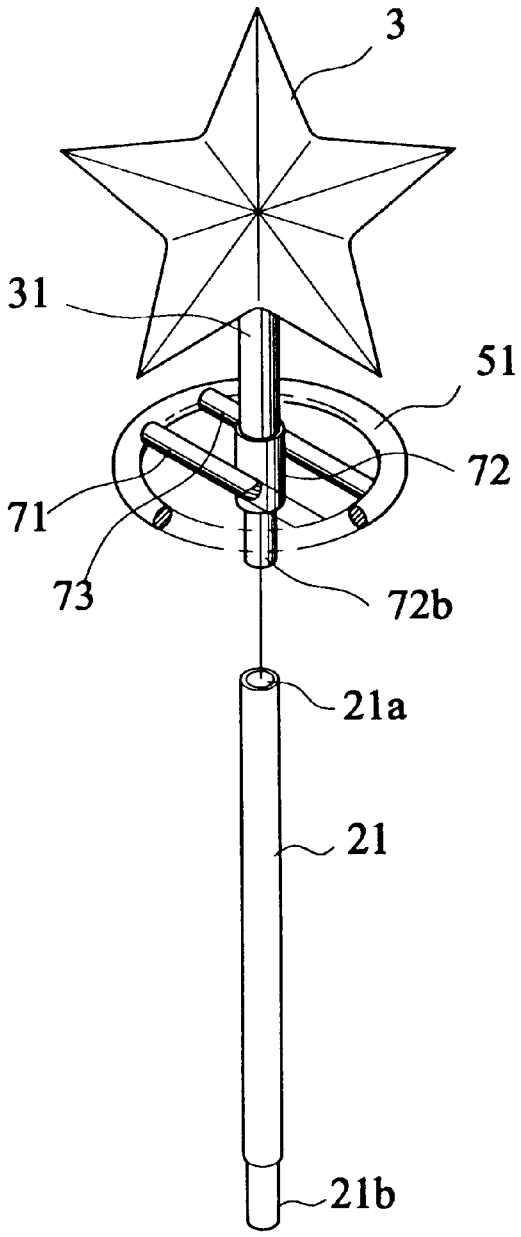
FIG. 3 is an enlarged view of the star-shape member and the top supporting ring of FIG. 1 in accordance with a best embodiment of the present invention.

With reference to FIG. 3, there is shown an enlarged view of the star-shape member and the top supporting ring of FIG. 1 in accordance with a preferred embodiment of the present invention. The top supporting ring 51 is formed with two sticks 71 and 73 arranged in parallel form for fixing a sleeve 72. The sleeve 72 has a reduced free end 72*b* adapted to be inserted into the open end 21*a* of the topmost section 21 of the central post 2. The star-shape hollow member 3 has an open end 31 for attaching to the sleeve 72. A number of bulbs (not shown) may be arranged inside the star-shape member 3 for further decorative purposes.

Although the present invention has been described with reference to the preferred embodiment, it is apparent to those skilled in the art that a variety of modifications and changes may be made without departing from the scope of the present invention which is intended to be defined by the appended claims.

What is claimed is:

1. A decorative, tree shaped light set comprising:

a) a central post having a top end and a bottom end;

b) an upper supporting ring having an annular configuration with two parallel cross-members on which is attached a mounting sleeve, the mounting sleeve being removably attached to the top end of the central post;

c) a plurality of lower supporting rings each having an annular configuration and disposed around the central post, the plurality of lower supporting rings being spaced apart from the upper supporting ring and from each other; and, d) a light string comprising a plurality of intersecting wires forming a rhombus-shaped mesh attached to the upper supporting ring and to each of the plurality of lower supporting rings at the intersections of the wires, whereby the light string comprises the sole support for the plurality of lower supporting rings, and a plurality of bulbs on the intersecting wires.

2. The Christmas light tree set as claimed in claim 1, wherein the central post comprises a plurality of sections detachably connected to each other.

3. The Christmas light tree set as claimed in claim 2, wherein each section has a reduced end received in an open end of an adjacent section of the central post.

4. The Christmas light tree set as claimed in claim 1, further comprising a star-shape member attached to the mounting sleeve of the upper supporting ring.

5. The Christmas light tree set as claimed in claim 1, further comprising a stand attached to the bottom end of the central post.

6. The Christmas light tree set as claimed in claim 1, wherein the diameter of each lower supporting ring increases sequentially from the top end to the bottom end of the central post.

* * * * *